United States Patent [19]

Kao

[11] Patent Number: 4,691,620

[45] Date of Patent: Sep. 8, 1987

[54] SELF-FLUSHING FLUID SEAL ASSEMBLY

[75] Inventor: David T. Kao, Lexington, Ky.

[73] Assignee: Board of Trustees of the University of KY, Lexington, Ky.

[21] Appl. No.: 725,225

[22] Filed: Apr. 19, 1985

[51] Int. Cl.[4] ..... F15B 21/04

[52] U.S. Cl. ..... 92/80; 92/82; 92/83; 92/86.5

[58] Field of Search ..... 92/80, 86.5, 87, 78, 92/82, 83; 417/900

[56] References Cited

U.S. PATENT DOCUMENTS

| | | | |
|---|---|---|---|
| 2,144,662 | 1/1939 | Paasche . | |
| 2,787,126 | 4/1957 | Kleczek | 62/1 |
| 3,104,619 | 9/1963 | Swarthout . | |
| 3,132,568 | 5/1964 | Strader | 92/78 |
| 3,146,940 | 9/1964 | McCrory . | |
| 3,256,827 | 6/1966 | Smith . | |
| 3,266,435 | 8/1966 | Smith . | |
| 3,279,383 | 10/1966 | Smith . | |
| 3,293,994 | 12/1966 | Napolitano | 92/82 |
| 3,316,817 | 5/1967 | Ellis | 92/82 |
| 3,334,906 | 8/1967 | Arnold | 92/82 |
| 3,540,219 | 11/1970 | Huruta | 60/577 |
| 3,774,506 | 11/1973 | Van der Aa | 92/83 |
| 3,802,805 | 4/1974 | Roeser | 417/398 |
| 3,818,805 | 6/1974 | Johansson | 92/82 |
| 3,818,807 | 6/1974 | Semple | 92/86.5 |
| 4,036,112 | 7/1977 | Hübschmann | 92/80 |
| 4,157,057 | 6/1979 | Bailey | 92/87 |
| 4,233,886 | 11/1980 | Balzano | 92/86.5 |
| 4,476,771 | 10/1984 | Kao | 92/78 |

FOREIGN PATENT DOCUMENTS

| | | |
|---|---|---|
| 2853347 | 6/1980 | Fed. Rep. of Germany . |
| 211936 | 1/1960 | Sweden . |

*Primary Examiner*—Abraham Hershkovitz
*Attorney, Agent, or Firm*—King & Schickli

[57] ABSTRACT

A self-flushing fluid seal assembly is provided to prevent particle intrusion into the main seal around a slurry pump shaft. The assembly includes an annular tube concentrically disposed about the pump shaft and forming a chamber. The volume of the chamber is made variable by a plunger comprising an enlarged diameter portion of the pump shaft movable relative to the chamber during the power and return stroke of the pump. Flushing liquid is delivered to the chamber by means of a feed line extending through the shaft. A check valve provided in the feed line opens to allow the inward flow of flushing fluid from the feed line to the chamber as the chamber expands. Conversely, the check valve closes and a secondary shaft seal is provided to prevent the reverse flow of flushing fluid as the chamber contracts on the return stroke. Thus, during chamber contraction the flushing fluid is forced from the chamber through a passage around the tube and through the main seal to prevent particle intrusion into the seal during pumping, thereby reducing wear.

9 Claims, 3 Drawing Figures

SELF-FLUSHING FLUID SEAL ASSEMBLY

TECHNICAL FIELD

The present invention relates to a new and useful improvement in pumps for use in pumping slurries or the like, and more particularly, to a self-flushing fluid seal assembly preventing particle intrusion into the main seal around a slurry pump shaft.

BACKGROUND ART

Presently and in the years ahead, the use of coal for energy is expected to become more and more economical and popular. Such use is critical if we are to relieve our dependency on imported petroleum and other liquid/gas fuels that continue to increase in price. In the past, coal has been shipped by railway, barge and trucks. Such methods of shipping suffice for relatively small quantities of coal. However, as the use of coal increases, it becomes more and more important to provide more economic methods to transport this fuel.

For many years, petroleum and petroleum products have been transported through pipelines over hundreds and hundreds of miles. The pipelines are capable of transporting massive volumes of fuel to the urban centers of the country at a fraction of the cost of other transportation modes. It, therefore, is not surprising that coal slurry pipelines for transporting coal suspended in water or other carrier liquids have been proposed. In fact, many successful slurry pipelines are in operation today. They, however, are mostly for conveying coal over a relatively short distance to a power plant from an adjacent mine.

A major drawback of a slurry pipeline is the abrasive effect of the solid coal and rock particles on the pump. Particles tend to intrude and lodge between the pumping cylinder and the sealing lip of the piston as well as between the pump shaft and the main seal in the cylinder head. The lodged particles can quickly damage the flexible seals and may, under certain conditions, quickly wear the cylinder and/or shaft to the point where an effective sealing relationship is lost. This results in the loss of pumping pressure. The pump must then be repaired, such as by inserting a new cylinder liner and/or piston, and of course, the seals must also be replaced. This repair and replacement greatly increases the cost of operation of slurry pumps. Thus, solving this problem would greatly enhance the economic feasibility of long-distance slurry pipelines.

Proposals in the past include injecting a liquid into the pump to form a more efficient sealant for the piston. If the metered sealant liquid, such as water, is fed at a sufficient pressure, the liquid seeps from around the seals to dislodge the solid particles before damage to the seals, shaft or cylinder can occur.

An improved self-flushing piston assembly designed to supply metered liquid supply to the periphery of the piston is shown in my issued U.S. Pat. No. 4,476,771, issued Oct. 16, 1984, and entitled Self-Flushing Piston Assembly for Slurry Pump. The piston assembly includes a slurry pump head having a pumping and lost motion piston coupled together. Flushing liquid is drawn into a variable volume chamber between the pistons during the suction or return stroke. On the power stroke, flushing liquid is ejected around the sealing periphery of the piston on the slurry side to prevent particle intrusion of the seal. An improvement invention wherein the output of the pump is substantially doubled is shown and claimed in my copending application, Double Acting Self-Flushing Pump, Ser. No. 726,181, filed Apr. 24, 1985.

The new pump assemblies of these issued patents, as well as others previously known in the art, however, fail to provide particle intrusion protection to a seal around the pump shaft. A need is, therefore, identified for an improved self-flushing fluid seal assembly for preventing particle intrusion into the main seal around a slurry pump shaft so as to reduce wear and, thereby, further reduce slurry pump maintenance and operating costs.

DISCLOSURE OF THE INVENTION

Accordingly, it is a primary object of the present invention to provide a slurry pump with a self-flushing fluid seal assembly that prevents particle intrusion into the seal around a slurry pump shaft.

A more specific object of the invention is to provide an improved self-flushing fluid seal assembly that prevents particle intrusion into the seal around a slurry pump shaft through the provision of a flushing liquid stream around the entire periphery of the seal.

Still another object of the invention is to provide a self-flushing fluid seal assembly that prevents particle intrusion into the seal around a slurry pump shaft as, for example, where the shaft extends through the cylinder head so as to reduce wear and, thereby, reduce slurry pump maintenance and operating costs.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved self-flushing fluid seal assembly is provided for preventing particle intrusion into the seal around a slurry pump shaft. It should be understood at the outset that the shaft fluid seal assembly of my present invention may be used with either my self-flushing single or double acting pumps, or in any other shaft driven pump or the like where a similar problem of particle intrusion is present.

The shaft fluid seal assembly includes a variable volume chamber concentrically disposed about the shaft. Plunging means for varying the volume of the chamber includes a portion of the pump shaft having an enlarged diameter movable relative to the chamber. Thus, during the piston drive stroke, the volume of the chamber increases and during the return stroke the volume of the chamber decreases.

Means, such as a flushing liquid feed line and check valve, are also provided for delivering flushing liquid through the shaft to the variable volume chamber. The check valve opens to allow the flow of flushing liquid from a supply source into the variable volume chamber. The check valve closes to prevent the flow of flushing liquid back toward the supply source during the return stroke of the pump. As the volume of the chamber is decreased, the flushing liquid is forced from the chamber through a passage for directing the flushing liquid in an annular stream around the entire periphery of the main seal so as to prevent particle intrusion into the seal during pumping.

Preferably, the variable volume chamber is formed by an annular tube concentrically disposed about the shaft. The inner diameter of the annular tube slidably engages the enlarged diameter portion of the pumping shaft so as to allow the volume of the chamber to be varied during the power and return stroke of the pump. The annular tube also extends between the variable volume chamber and the passage so that the passage is concentrically disposed around the variable volume chamber within the cylinder head wall.

The annular tube is elongated to provide an effective volume of flushing liquid to assure removal of all particles from the main seal area. There may be migration of some particles to the slurry side of the seal area during the power stroke, but on each return stroke the flushing liquid quickly clears the particles and effectively prevents any particles from lodging therein.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
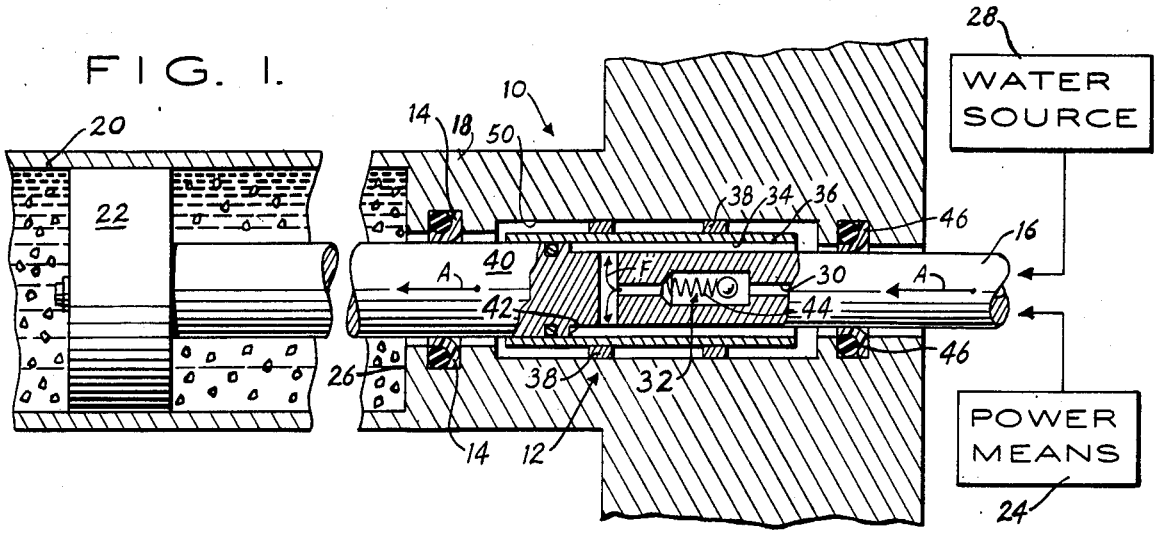
FIG. 1 is a schematical cross-sectional representation of a pumping system including the pump shaft seal assembly of the present invention shown during the delivery of flushing liquid from the supply source to the variable volume chamber.

Reference is now made to FIG. 1 illustrating schematically a slurry pumping system 10 designed to utilize the improved self-flushing fluid seal assembly 12 of the present invention. Particle intrusion into main wiper seal 14 around a slurry pump shaft or rod 16 in the cylinder head wall 18 is effectively prevented in accordance with the novel aspects of the invention.

As is known in the art and discussed in my previous U.S. patents, the pump chambers receive slurry from a source which is then tranferred by the pump along a line through check valves to a suitable receiver, such as a holding tank (not shown in the present drawing). Other, subsequent operations may then be performed on the slurry after the slurry is taken from the tank. Although the present pumping system is being described for handling coal slurry in my double acting pump, it should, of course, be recognized that other types of aggregate suspensions and pumps can be utilized with the same increased efficiency and reduced wear.

Thus, the pumping system 10 includes a cylinder 20 that extends from the head wall 18. Slidably received inside the cylinder 20 is a piston assembly, generally designated by reference numeral 22. The piston assembly 22 is double acting may be specifically constructed in accordance with my copending application, Ser. No. 726,681 filed on Apr. 24, 1985 and entitled Double Acting Self-Flushing Pump. In this instance, slurry pumping action is provided on both the power and return stroke of the piston assembly. It should be recognized, however, that the piston assembly 22 forms no part of the present invention and, therefore, is not shown in detail in the drawing. The piston assembly may simply be constructed in accordance with any structure known in the art for pumping slurry.

Figure 2:
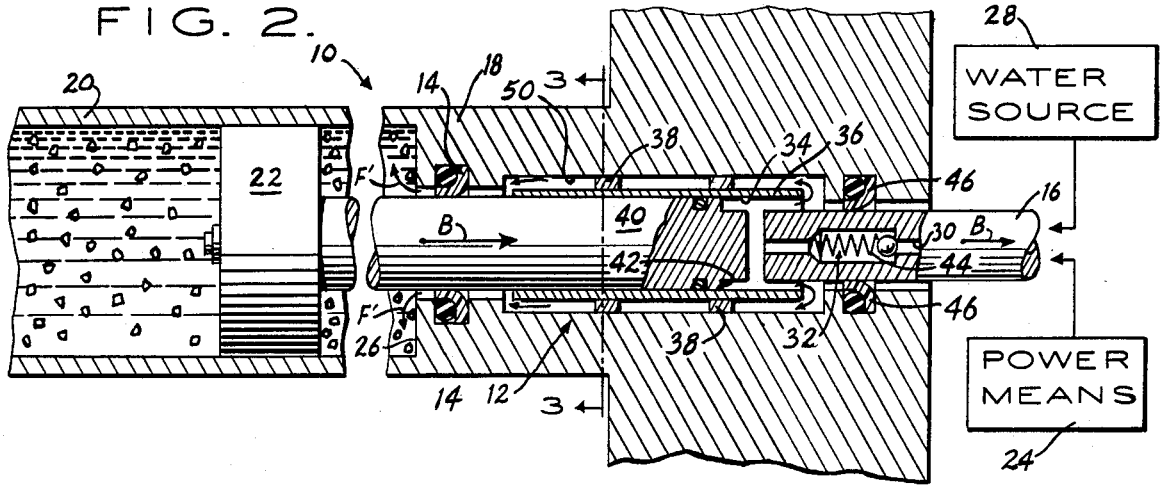
FIG. 2 is a view similar to FIG. 1 showing the pump shaft seal assembly of the present invention injecting flushing liquid from the variable volume chamber through the main seal between the pump shaft and the cylinder head wall into the slurry.

To review briefly the operation of the pump system 10, as power means 24 moves the pump shaft 16 to the left (note action arrow A in FIG. 1) the piston assembly 22 also moves to the left and slurry in the cylinder 20 on the left side of the piston assembly is pumped toward the receiving means or holding tank (not shown). As best shown in FIG. 2, when the reciprocating power means 24 reverses, the pump shaft 16 and piston assembly 22 move to the right (note action arrow B) and slurry in the cylinder 20 on the right side of the piston assembly is pumped toward the receiving means or holding tank (not shown).

During this return movement of the pump shaft 16 in the direction of action arrow B, it should be recognized that slurry particles clinging to the pump shaft 16, or simply in the general area of the main seal 14 in the cylinder head 18 would likely lodge against the face of the seal. Such lodging of particles at the interface between the main seal 14 and the pump shaft 16 could lead to some intrusion if not removed, and thus deleterious wear through abrasion as the pump shaft reciprocates. The wear can quickly lead to a damaged seal 14 and pump shaft surface and a consequent loss of pumping pressure.

The self-flushing fluid seal assembly 12 of the present invention eliminates this problem by insuring that an annular stream of flushing liquid is injected into the slurry around the entire periphery of the seal 14 during the stroke of the piston assembly 22 and shaft 16. The injected flushing liquid advantageously removes slurry particles and grit from the seal area as fast as accumulated so that the shaft remains free to move through the seal 14 with a cleared area around its full periphery.

Figure 3:
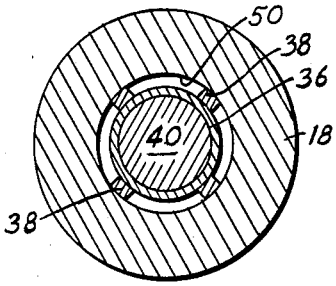
FIG. 3 is a cross-sectional view taken along line 3—3 of FIG. 2 and showing further details of the construction of the self-flushing pump shaft seal assembly of the present invention.

As shown, the self-flushing assembly 12 is formed in the cylinder head wall 18 just behind the main seal 14. The flushing liquid is supplied from a suitable supply means, such as clear water source 28. The water is fed through a line 30 and check valve 32 in the pump shaft 16 to a variable volume chamber 34 (note flow arrow F). The variable volume chamber 34 is concentrically disposed around the pump shaft 16 and formed between the pump shaft and an annular tube 36. As shown in cross-section in FIG. 3, the annular tube 36 is held in position by means of spacers 38 to the cylinder head wall 18.

As shown, the pump shaft 16 includes a portion 40 of enlarged diameter that is movable relative to the chamber 34. The enlarged portion 40 of the shaft 16 is slidably received in and cooperates with the annular tube 36 so as to act as a plunger and vary the volume of the chamber 34 with each stroke of the reciprocating power means 24.

As the reciprocating power means 24 advances the shaft 16 and piston assembly 22 to the left in the direction of arrow A in FIG. 1, the volume of the chamber 34 increases. This increase in volume creates a zone of low pressure in the chamber 34 that causes the check valve 32 to open. As briefly explained above, this causes delivery of flushing liquid to fill the chamber 34 from the line 30.

As the reciprocating power means 24 reverses and moves the shaft 16 and the piston assembly 22 to the right (note action arrow B in FIG. 2), the volume of the chamber 34 decreases with face 42 of the enlarged shaft portion 40 forcing flushing liquid from the chamber. The spring 44 closes the check valve 32 so as to prevent the flow of flushing liquid from the decreasing volume chamber 34 into the line 30. Similarly, a secondary wiper seal 46 prevents flushing liquid from escaping around the shaft 16. The flushing liquid thus forced from the chamber 34 therefore moves through the annular delivery passage 50 toward the main seal 14. As shown, the delivery passage 50 is concentrically disposed about the pump shaft 16 between the annular tube 36 and the cylinder head wall 18.

The flushing liquid that is forced down the passage 50 during continued movement of the shaft 16 and piston head 22 to the right (note arrow B in FIG. 2) squeezes past the main wiper seal 14 and is injected into the slurry in the form of a jet stream around the full periphery of the shaft (note flow arrows F' in FIG. 2). As this occurs, material is blocked and/or removed from the seal area. Advantageously, this results in preventing the deleterious abrasion and wear to the pump shaft 16 and the seal 14.

In summary, numerous benefits have been described which result from employing the concepts of the pump shaft seal assembly of the present invention. The pump shaft seal assembly 12 is self-flushing through the provision of a jet-action annular stream of flushing liquid that prevents particulate matter from entering the seal 14 or adhering to the pump shaft 16 adjacent the seal. Advantageously, it should also be recognized that the pump shaft assembly 12 of the present invention in no way adversely affects piston and shaft alignment or restricts shaft travel. Further, the assembly 12 requires a minimum amount of flushing liquid and may be easily retrofitted onto existing reciprocal pumps with only limited design modification.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, the enlarged portion 40 of the pump shaft 16 that acts as a plunger may simply be an enlarged band disposed about the shaft. Other types of seals may be used, either as a main or a secondary seal. The standard wiper seals 14, 46, respectively, have been shown for illustrative purposes only. The embodiment was chosen and described to provide the best illustration of the principles of the invention and its practical application to thereby enable one of ordinary skill in the art to utilize the invention in various embodiments and with various modifications as they are suited to the particular use contemplated. All such modifications and variations are within the scope of the invention as determined by the appended claims when interpreted in accordance with the breadth to which they are fairly, legally and equitably entitled.

I claim:

1. A self-flushing fluid seal assembly to prevent particle intrusion into a seal around a drive shaft of a slurry pump during a return stroke of said pump when a portion of said drive shaft is retracted past said seal comprising:

a variable volume chamber concentrically disposed about the shaft;

means for delivering flushing liquid to said variable volume chamber on a power stroke of said pump when a portion of said drive shaft is extended past said seal;

plunging means for varying the volume of said chamber, said plunging means including a pumping face directed away from said seal for increasing the volume of said chamber and for receipt of flushing liquid on said power stroke and decreasing the volume of said chamber for forcing liquid from said chamber on said return stroke;

the sealing of said seal being effective during the power stroke and the lack of sealing during the return stroke caused by the presence of flushing liquid;

passage means for redirecting liquid received from said variable volume chamber extending in the opposite direction into and through the seal around the shaft to provide a smooth, annular flushing stream that prevents particle intrusion into said seal during pumping, thereby reducing wear.

2. The self-flushing fluid seal assembly of claim 1, wherein said variable volume chamber is formed by an annular tube concentrically disposed about the shaft.

3. The self-flushing fluid seal assembly of claim 2, wherein said annular tube extends between said variable volume chamber and said passage means.

4. The self-flushing fluid seal assembly of claim 1, wherein said delivering means includes a check valve means that opens to allow the flow of flushing liquid from supply means into said variable volume chamber as the volume of said chamber increases and closes to prevent the flow of fluid as the volume of said chamber decreases.

5. The self-flushing fluid seal assembly of claim 1, wherein said passage means are concentrically disposed around said variable volume chamber and a cylinder being formed around said sleeve and providing a space to define said passage means.

6. The self-flushing fluid seal assembly of claim 1, wherein said plunging means includes a portion of the shaft having an enlarged diameter moveable relative to said chamber for pushing the flushing liquid from said variable volume chamber through said passage means and the seal around the shaft so as to prevent particle intrusion into the seal.

7. The self-flushing fluid seal assembly of claim 2, wherein said plunging means includes a portion of the shaft having an enlarged diameter moveable relative to said chamber, said enlarged diameter portion being received in and cooperating with said annular tube to vary the volume of said chamber and force flushing liquid from the chamber through said passage means and the seal around the shaft so as to prevent particle intrusion into the seal.

8. The self-flushing fluid seal assembly of claim 1, wherein is provided a secondary seal around said shaft adjacent said chamber to prevent loss of fluid in the reverse direction.

9. The self-flushing fluid seal assembly of claim 1, wherein said flushing liquid is delivered through said shaft.

* * * * *